US007765896B1

(12) United States Patent
Chen

(10) Patent No.: US 7,765,896 B1
(45) Date of Patent: Aug. 3, 2010

(54) REVERSIBLE RATCHET WRENCH WHOSE OPERATION DIRECTIONS ARE CHANGED EASILY AND QUICKLY

(76) Inventor: Wei-Chu Chen, 127, Jhongmin Rd., Baojhong Township, Yunlin County (TW)

( * ) Notice: Subject to any disclaimer, the term of this patent is extended or adjusted under 35 U.S.C. 154(b) by 9 days.

(21) Appl. No.: 12/186,050

(22) Filed: Aug. 5, 2008

(51) Int. Cl.
*B25B 13/46* (2006.01)

(52) U.S. Cl. ..... 81/58.5; 81/63.2

(58) Field of Classification Search ..... 81/63.2, 81/58, 58.4, 58.5
See application file for complete search history.

(56) References Cited

U.S. PATENT DOCUMENTS 1,019,825 A * 3/1912 Mossberg ..... 81/58.5
1,113,248 A * 10/1914 Rice ..... 81/58
1,798,481 A * 3/1931 McNaught et al. ..... 74/145
1,798,482 A * 3/1931 McNaught et al. ..... 74/145
6,978,699 B2 * 12/2005 Yuan-Chin et al. ..... 81/58.5
7,197,964 B2 * 4/2007 Buchanan ..... 81/58
2002/0170393 A1 * 11/2002 Yuan-Chin et al. ..... 81/58.5

* cited by examiner

*Primary Examiner*—David B Thomas
(74) *Attorney, Agent, or Firm*—Alan Kamrath; Kamrath & Associates PA

(57) ABSTRACT

A reversible ratchet wrench includes a drive shank having a support base, an open shell pivotally mounted on the support base, a ratchet wheel having a plurality of ratchet teeth, a pawl member having a sliding face slidably mounted on the support base and a toothed engaging face meshing with the ratchet teeth, and a cover to cover the ratchet wheel, the pawl member and the support base of the drive shank. The shell is pivoted relative to the support base to change the operation direction of the ratchet wheel. Thus, the user only needs to hold and pivot the shell relative to the support base to change the operation direction of the ratchet wheel, so that the user can change the operation direction of the ratchet wheel easily and quickly.

18 Claims, 7 Drawing Sheets

REVERSIBLE RATCHET WRENCH WHOSE OPERATION DIRECTIONS ARE CHANGED EASILY AND QUICKLY

BACKGROUND OF THE INVENTION

1. Field of the Invention

The present invention relates to a ratchet wrench and, more particularly, to a reversible ratchet wrench that co-operates with a socket to operate a workpiece (such as a nut and the like) in two opposite directions.

2. Description of the Related Art

A conventional reversible ratchet wrench in accordance with the prior art shown in FIG. 7 comprises a drive shank 60 having an end portion provided with a support base 61 which has a receiving chamber 62, a receiving space 63, a through hole 631 and a positioning recess 632, a ratchet wheel 80 mounted in the receiving chamber 62 of the support base 61 and having an outer wall provided with a plurality of ratchet teeth 81, a pawl member 70 mounted in the receiving space 63 of the support base 61 and having a first side provided with a toothed engaging face 72 meshing with the ratchet teeth 81 of the ratchet wheel 80 and a second side provided with a triangular protrusion 71 which has two opposite oblique faces 73, a positioning ball 65 mounted in the positioning recess 632 of the support base 61 and abutting one of the two oblique faces 73 of the protrusion 71 of the pawl member 70, an elastic member 64 mounted in the positioning recess 632 of the support base 61 and biased between the support base 61 of the drive shank 60 and the positioning ball 65 to push the positioning ball 65 toward the protrusion 71 of the pawl member 70, a control shaft 74 extending through the through hole 631 of the support base 61 and inserted into the pawl member 70 to rotate and move the pawl member 70 relative to the positioning ball 65, a control lever 75 mounted on the control shaft 74 and located outside of the support base 61 of the drive shank 60 to drive the control shaft 74 to move the pawl member 70, and a cover 90 mounted on the support base 61 of the drive shank 60 to cover the ratchet wheel 80 and the pawl member 70. The cover 90 is combined with the support base 61 of the drive shank 60 by two locking bolts 93. The cover 90 is provided with a first limit hole 91 to limit the ratchet wheel 80 and a second limit hole 92 to limit the pawl member 70. The support base 61 of the drive shank 60 has a bottom provided with a limit bore 621 to limit the ratchet wheel 80. The ratchet wheel 80 has a side provided with a square drive stud 82 extending through and protruding outwardly from the first limit hole 91 of the cover 90 for mounting a socket to operate a workpiece, such as a nut and the like. Thus, a user can drive the control lever 75 to drive the control shaft 74 which drives the pawl member 70 to move relative to the positioning ball 65, so that the positioning ball 65 abuts one of the two oblique faces 73 of the protrusion 71 of the pawl member 70 so as to change the operation direction of the ratchet wheel 80. However, the user has to drive the control lever 75 to change the operation direction of the ratchet wheel 80, thereby causing inconvenience to the user.

BRIEF SUMMARY OF THE INVENTION

The primary objective of the present invention is to provide a reversible ratchet wrench whose operation directions are changed easily and quickly.

Another objective of the present invention is to provide a reversible ratchet wrench, wherein the shell is pivoted relative to the support base of the drive shank, so that each of the two positioning members is movable into the respective first positioning groove or the respective second positioning groove of the shell so as to change the operation direction of the ratchet wheel easily and conveniently.

A further objective of the present invention is to provide a reversible ratchet wrench, wherein the user only needs to hold and pivot the shell relative to the support base of the drive shank so as to change the operation direction of the ratchet wheel, so that the user can change the operation direction of the ratchet wheel easily and quickly, thereby facilitating the user operating the reversible ratchet wrench.

A further objective of the present invention is to provide a reversible ratchet wrench, wherein the user only needs to hold the support base of the drive shank to shake the shell and to drive the shell to pivot relative to the support base of the drive shank by the weight of the shell and the ratchet wheel so as to change the operation direction of the ratchet wheel, so that the user can change the operation direction of the ratchet wheel easily and quickly, thereby facilitating the user operating the reversible ratchet wrench.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
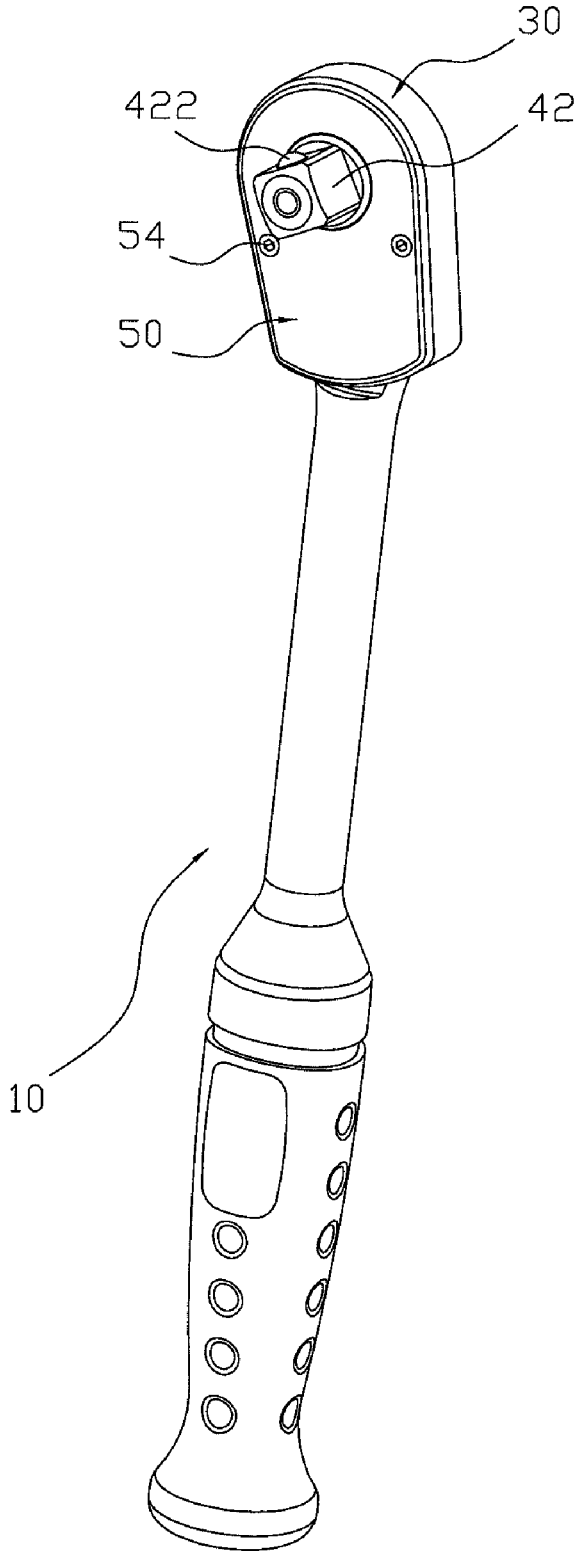
FIG. 1 is a perspective view of a reversible ratchet wrench in accordance with the preferred embodiment of the present invention.
Figure 2:
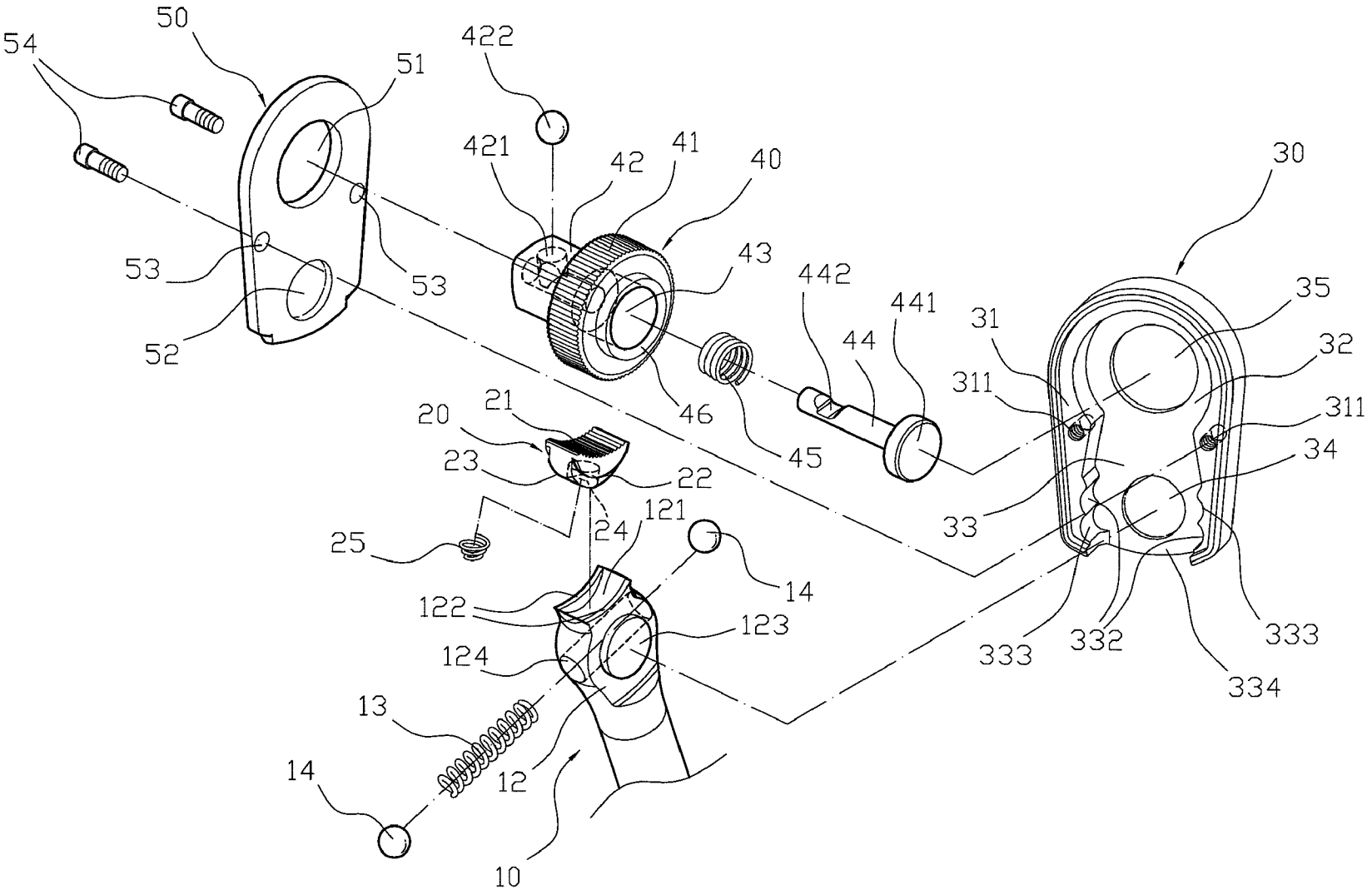
FIG. 2 is an exploded perspective view of the reversible ratchet wrench as shown in FIG. 1.
Figure 3:
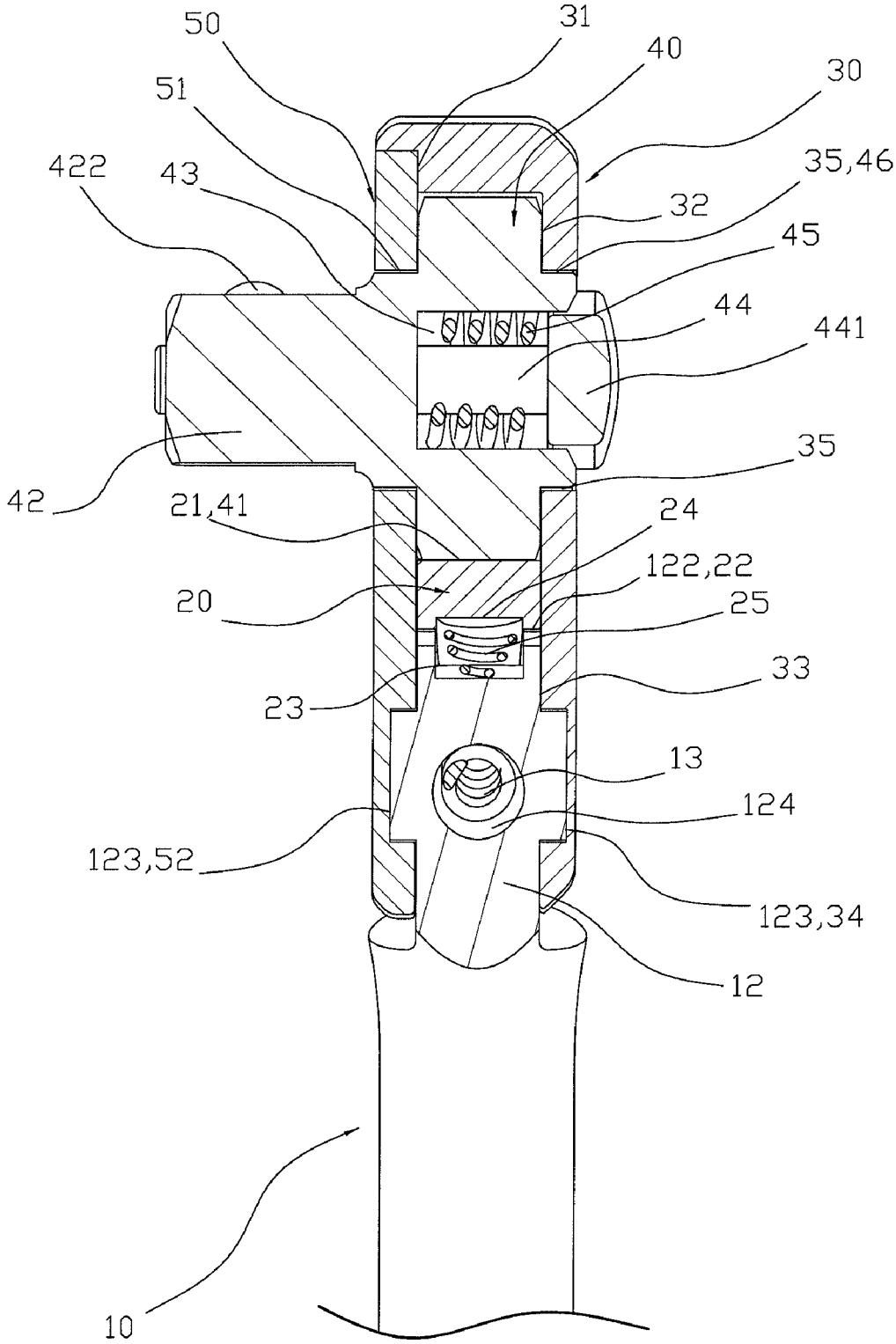
FIG. 3 is a side cross-sectional view of the reversible ratchet wrench as shown in FIG. 1.
Figure 4:
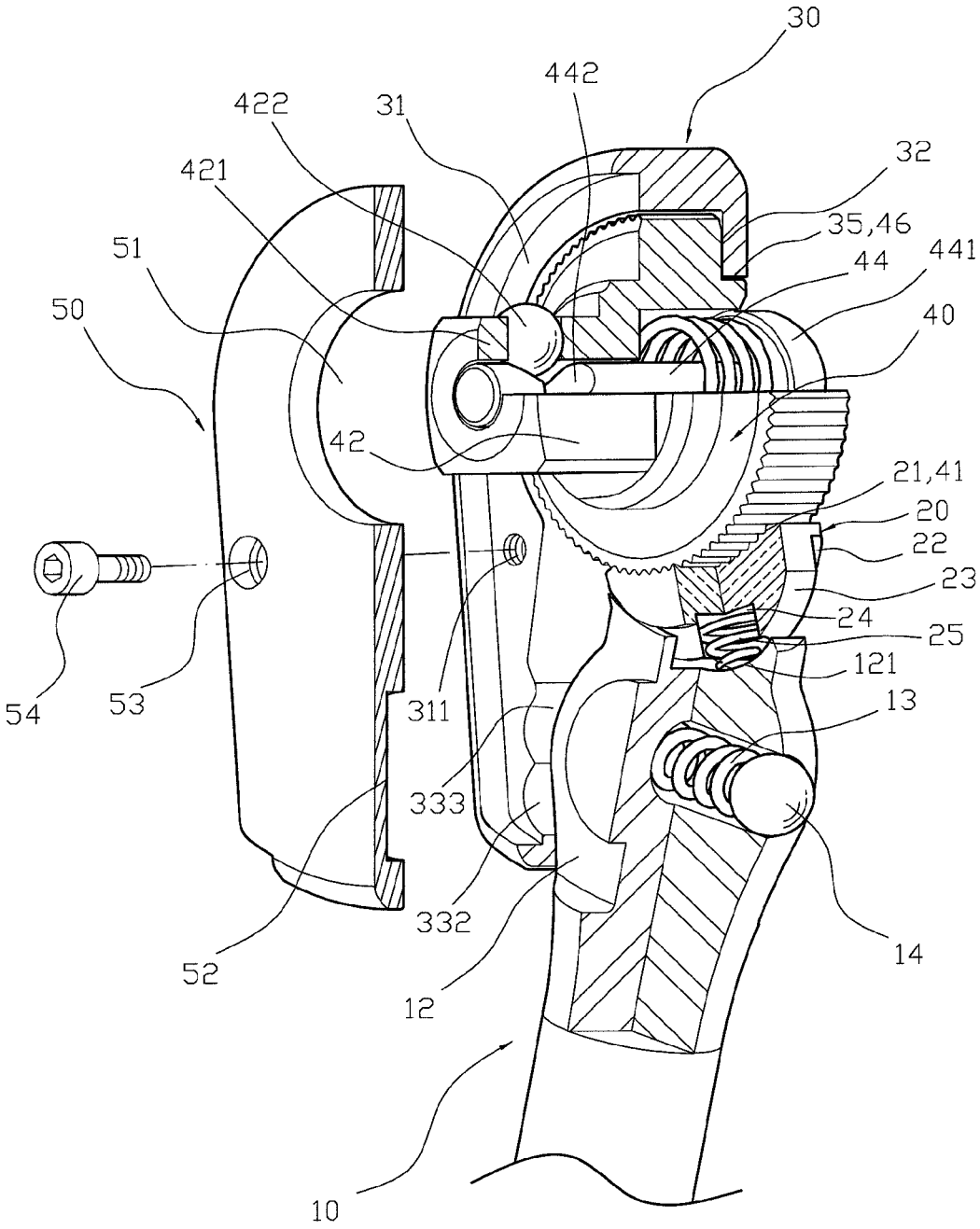
FIG. 4 is a partially exploded perspective cross-sectional view of the reversible ratchet wrench as shown in FIG. 1.

Referring to the drawings and initially to FIGS. 1-5, a reversible ratchet wrench in accordance with the preferred embodiment of the present invention comprises a drive shank 10 having an end portion provided with a support base 12, an open shell 30 pivotally mounted on the support base 12 of the drive shank 10, a ratchet wheel 40 mounted in the shell 30 and having an outer wall provided with a plurality of ratchet teeth 41, a pawl member 20 mounted between the support base 12 of the drive shank 10 and the ratchet wheel 40 and having a first side provided with a sliding face 23 slidably mounted on the support base 12 of the drive shank 10 and a second side provided with a toothed engaging face 21 meshing with the ratchet teeth 41 of the ratchet wheel 40, and a cover 50 mounted on the shell 30 to cover the ratchet wheel 40, the pawl member 20 and the support base 12 of the drive shank 10.

The support base 12 of the drive shank 10 has an end face provided with two opposite arcuate guide rails 122 and an arcuate slideway 121 defined between the two guide rails 122. The support base 12 of the drive shank 10 has an inside provided with a receiving hole 124. The support base 12 of the drive shank 10 is provided with two opposite protruding pivot seats 123.

The pawl member 20 is mounted in the shell 30 and has a substantially semi-circular shape. The sliding face 23 of the pawl member 20 is slidably mounted in the slideway 121 of the drive shank 10 and has opposite sides each provided with a guide track 22 slidable on a respective one of the two guide rails 122 of the drive shank 10. The sliding face 23 of the pawl member 20 has a central portion provided with a mounting hole 24 connected to the slideway 121 of the drive shank 10.

The reversible ratchet wrench further comprises an elastic push member 25 biased between the support base 12 of the drive shank 10 and the sliding face 23 of the pawl member 20 to push the pawl member 20 toward the ratchet wheel 40. The elastic push member 25 is mounted in the mounting hole 24 of the pawl member 20 and extended into the slideway 121 of the drive shank 10.

The shell 30 has a first side provided with a pivot hole 34 pivotally mounted on one of the two pivot seats 123 of the drive shank 10 and a limit hole 35 to limit the ratchet wheel 40. The shell 30 has an open second side provided with a recessed mounting portion 31 for mounting the cover 50 which is fully received and hidden in the mounting portion 31 of the shell 30. The mounting portion 31 of the shell 30 is provided with two screw bores 311. The shell 30 has a first end provided with an adjusting space 33 pivotally mounted on the support base 12 of the drive shank 10 and a second end provided with a receiving space 32 connected to the adjusting space 33 to receive the ratchet wheel 40. The receiving space 32 of the shell 30 has a substantially circular shape. The adjusting space 33 of the shell 30 has two opposite sidewalls each provided with a first positioning groove 332 and a second positioning groove 333. The first positioning grooves 332 and the second positioning grooves 333 of the two opposite sidewalls of the adjusting space 33 of the shell 30 are diagonally opposite to each other. The first end of the shell 30 has an end face provided with an opening 334 connected to the adjusting space 33 to allow passage of the support base 12 of the drive shank 10.

The reversible ratchet wrench further comprises two opposite positioning members 14 each movably mounted in the receiving hole 124 of the drive shank 10 and each detachably positioned in any one of the respective first positioning groove 332 and the respective second positioning groove 333 of the shell 30, and an elastic member 13 mounted in the receiving hole 124 of the drive shank 10 and biased between the two positioning members 14 to push each of the two positioning members 14 toward any one of the respective first positioning groove 332 and the respective second positioning groove 333 of the shell 30.

The cover 50 is secured in the mounting portion 31 of the shell 30. The cover 50 is provided with a pivot bore 52 pivotally mounted on the other one of the two pivot seats 123 of the drive shank 10 and a limit bore 51 to limit the ratchet wheel 40. The cover 50 is further provided with two fixing holes 53, and the reversible ratchet wrench further comprises two locking bolts 54 each extending through a respective one of the two fixing holes 53 of the cover 50 and each screwed into a respective one of the two screw bores 311 of the shell to combine the cover 50 with the shell 30.

The ratchet wheel 40 is mounted in the receiving space 32 of the shell 30 to move in concert with the shell 30 relative to the support base 12 of the drive shank 10. The ratchet wheel 40 has a first side provided with a square drive stud 42 extending through and protruding outwardly from the limit bore 51 of the cover 50 and a second side provided with a protruding limit flange 46 inserted into the limit hole 35 of the shell 30. The drive stud 42 of the ratchet wheel 40 has a side provided with a positioning hole 421 to receive a positioning ball 422 which partially protrudes outwardly from the positioning hole 421 of the ratchet wheel 40. The ratchet wheel 40 has an inside provided with a stepped receiving chamber 43 connected to the positioning hole 421.

The reversible ratchet wrench further comprises a control rod 44 movably mounted in the receiving chamber 43 of the ratchet wheel 40 and having a first end provided with a control recess 442 that is movable to align with and receive the positioning ball 422 and a second end provided with an enlarged control knob 441 protruding outwardly from the receiving chamber 43 of the ratchet wheel 40 and the limit hole 35 of the shell 30, and an elastic element 45 mounted on the control rod 44 and biased between the ratchet wheel 40 and the control knob 441 of the control rod 44 to move the control recess 442 of the control rod 44 to push the positioning ball 422 outwardly from the positioning hole 421 of the ratchet wheel 40. The elastic element 45 is received in the receiving chamber 43 of the ratchet wheel 40.

As shown in FIGS. 1-4, when the control knob 441 of the control rod 44 is pressed toward the ratchet wheel 40, the control recess 442 of the control rod 44 is movable to align with and receive the positioning ball 422 so that the positioning ball 422 is fully retracted into the positioning hole 421 of the ratchet wheel 40. Thus, a socket (not shown) can be mounted on (or removed from) the drive stud 42 of the ratchet wheel 40. After the socket is mounted on the drive stud 42 of the ratchet wheel 40, the force applied on the control knob 441 of the control rod 44 is removed, so that the control knob 441 of the control rod 44 is pushed outwardly relative to the ratchet wheel 40 by the restoring force of the elastic element 45, and the control recess 442 of the control rod 44 is movable to detach from the positioning ball 422 and to push the positioning ball 422 outwardly from the positioning hole 421 of the ratchet wheel 40 so as to press the inner wall of the socket, thereby locking the socket onto the drive stud 42 of the ratchet wheel 40. Thus, the drive stud 42 of the ratchet wheel 40 can co-operate with the socket to operate a workpiece, such as a nut and the like.

Figure 5:
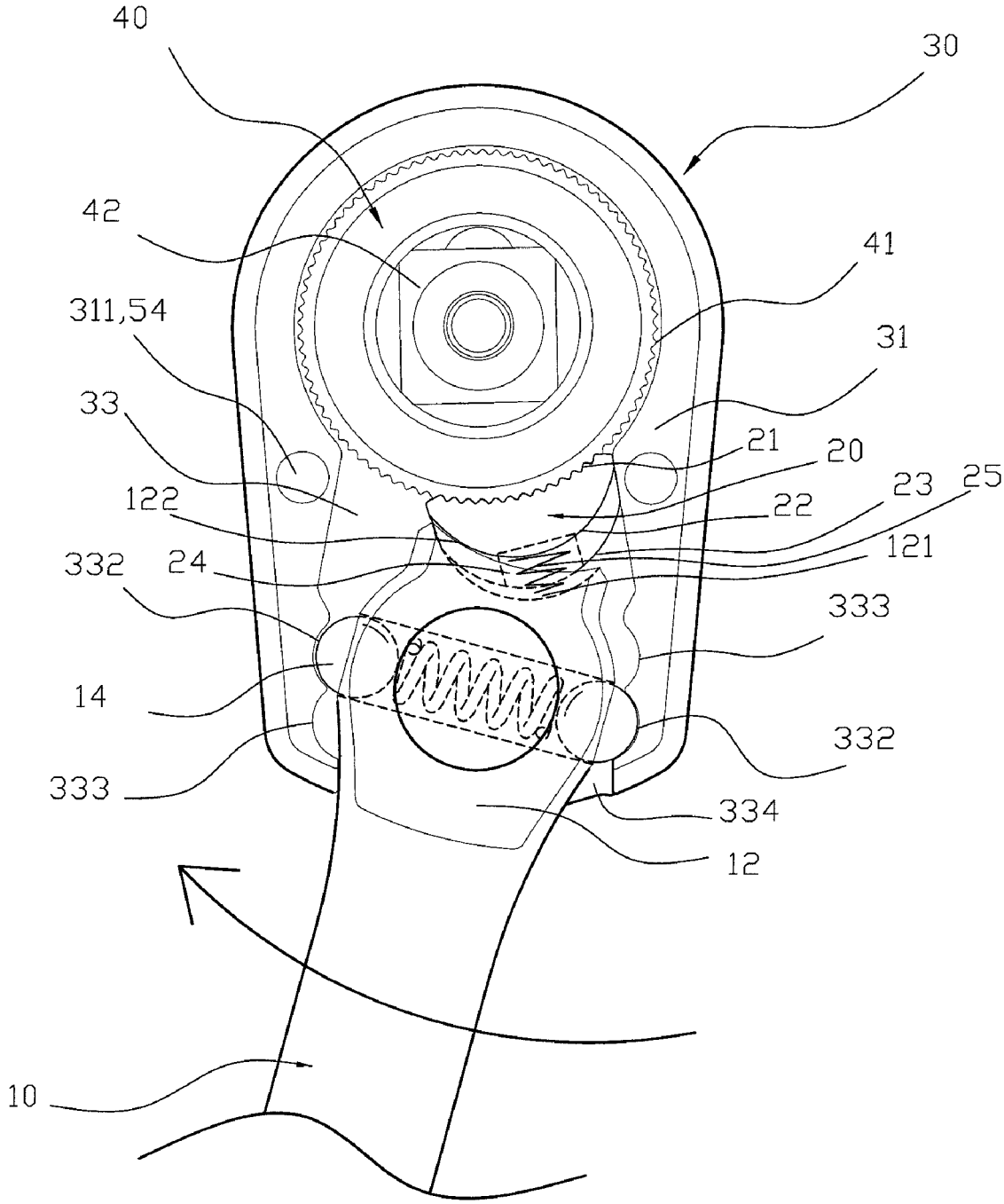
FIG. 5 is a front broken view of the reversible ratchet wrench as shown in FIG. 1.
Figure 6:
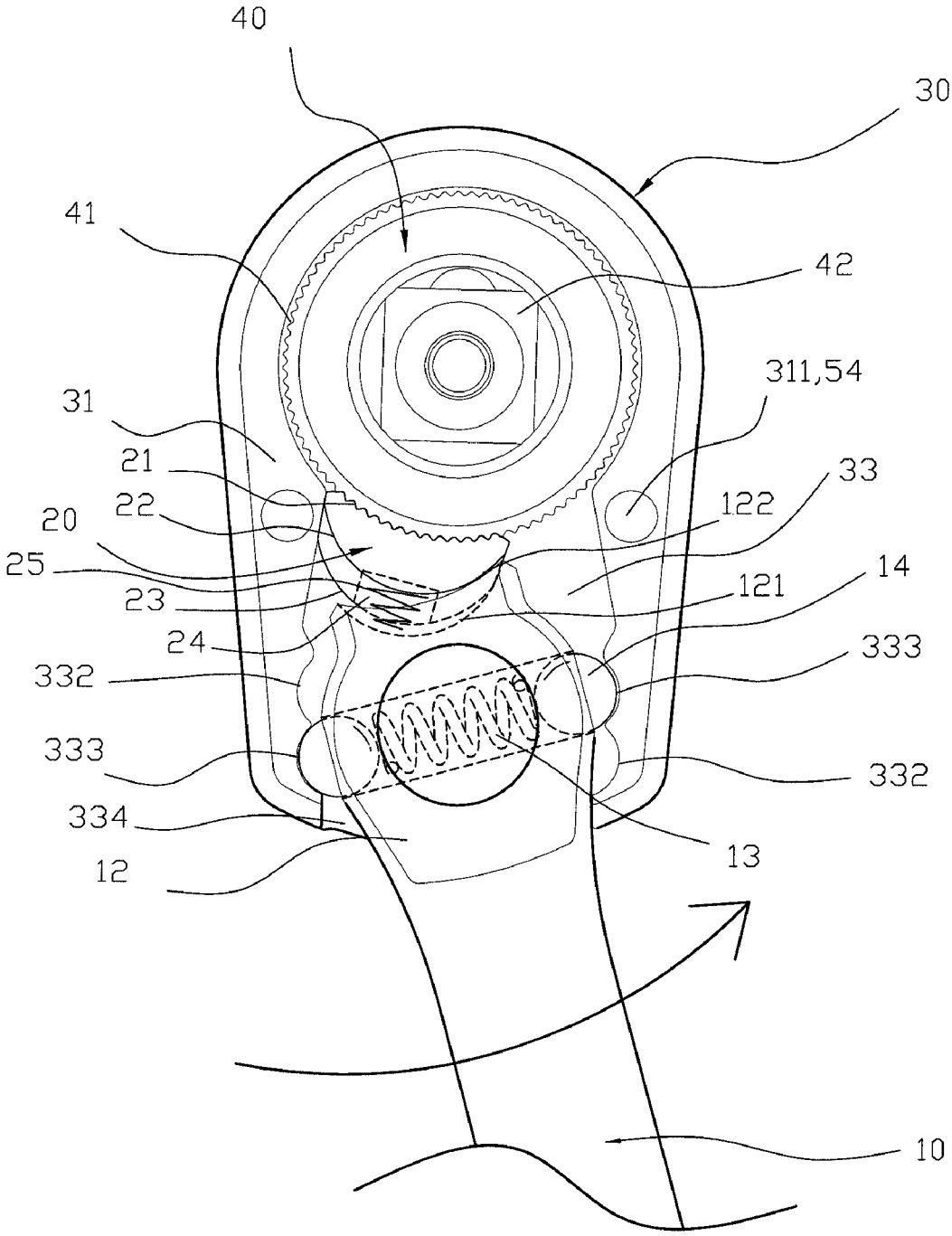
FIG. 6 is a schematic operational view of the reversible ratchet wrench as shown in FIG. 5.
Figure 7:
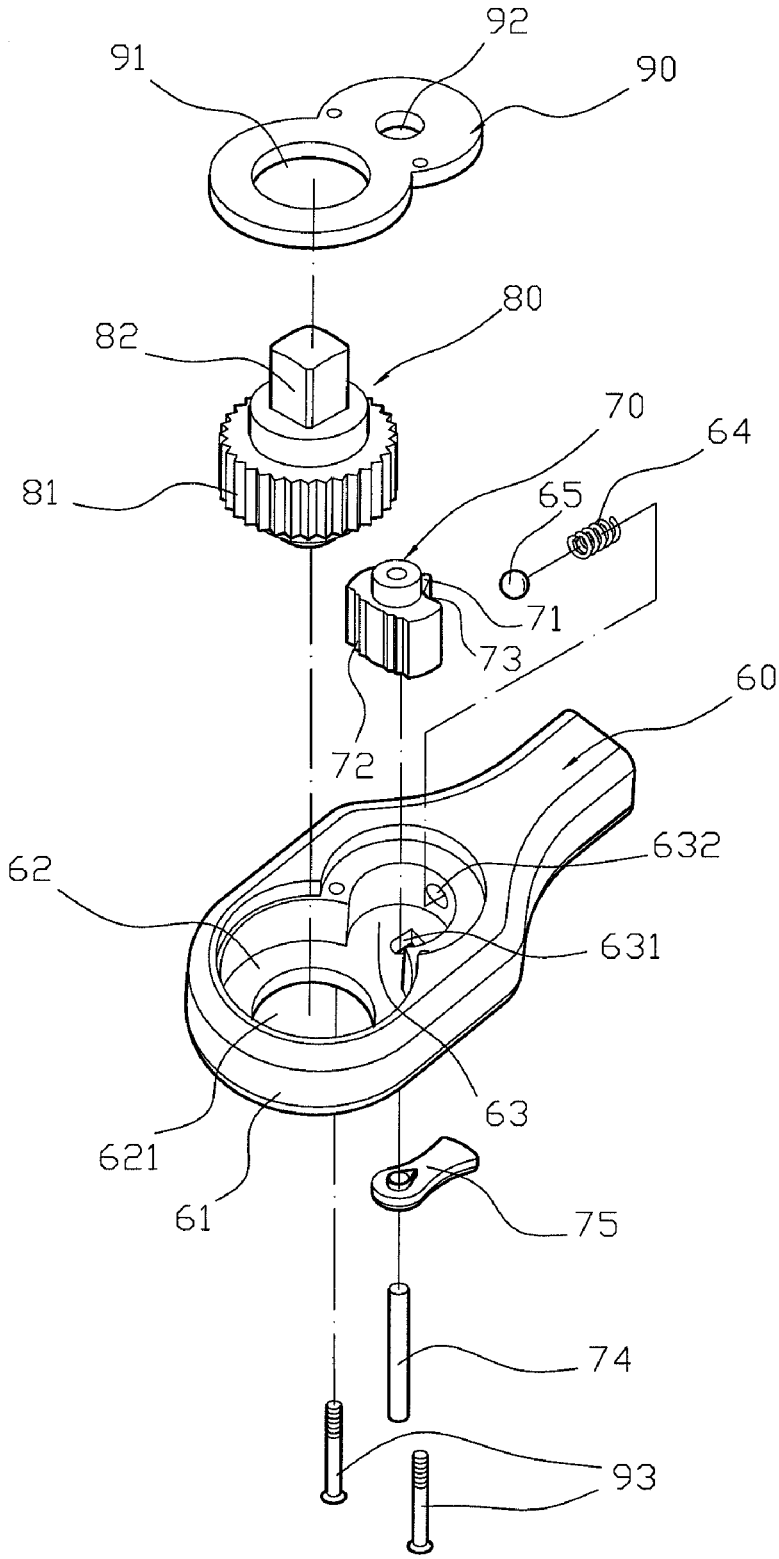
FIG. 7 PRIOR ART
FIG. 7 is an exploded perspective view of a conventional reversible ratchet wrench in accordance with the prior art.

In operation, referring to FIGS. 5 and 6 with reference to FIGS. 1-4, when a user wishes to change the operation direction of the ratchet wheel 40 of the reversible ratchet wrench, the shell 30 is held by the user to pivot relative to the support base 12 of the drive shank 10. Alternatively, the user can hold the support base 12 of the drive shank 10 to shake the shell 30 so as to drive the shell 30 to pivot relative to the support base 12 of the drive shank 10 by the weight of the shell 30 and the ratchet wheel 40. At this time, the toothed engaging face 21 of the pawl member 20 meshes with the ratchet teeth 41 of the ratchet wheel 40, and the ratchet wheel 40 is driven by the shell 30 to move relative to the support base 12 of the drive shank 10 when the shell 30 is pivoted relative to the support base 12 of the drive shank 10, so that the pawl member 20 is driven by the ratchet wheel 40 to move relative to the support base 12 of the drive shank 10, the sliding face 23 of the pawl member 20 is slidable in the slideway 121 of the drive shank 10, and the guide tracks 22 of the pawl member 20 are slidable on the two guide rails 122 of the drive shank 10. When the shell 30 is pivoted relative to the support base 12 of the drive shank 10, the two positioning members 14 are not subjected to the resistance of the ratchet wheel 40, so that each of the two positioning members 14 is movable into the respective first positioning groove 332 of the shell 30 as shown in FIG. 5 or into the respective second positioning groove 333 of the shell 30 as shown in FIG. 6 so as to change the operation direction of the ratchet wheel 40.

As shown in FIG. 5 with reference to FIGS. 1-4, each of the two positioning members 14 is positioned in the respective first positioning groove 332 of the shell 30, and the pawl member 20 rests on the right side of the adjusting space 33 of the shell 30. In such a manner, when the support base 12 of the drive shank 10 is rotated in the clockwise direction, the slideway 121 of the drive shank 10 presses the sliding face 23 of the pawl member 20 to push the toothed engaging face 21 of the pawl member 20 toward the ratchet teeth 41 of the ratchet wheel 40, so that the toothed engaging face 21 of the pawl member 20 closely engages the ratchet teeth 41 of the ratchet wheel 40 to combine the pawl member 20 and the ratchet wheel 40 together, and the ratchet wheel 40 is rotated with the pawl member 20. Thus, when the support base 12 of the drive shank 10 is rotated in the clockwise direction, the pawl member 20 and the ratchet wheel 40 are combined together, so that the socket mounted on the drive stud 42 of the ratchet wheel 40 is driven by the support base 12 of the drive shank 10 to rotate the workpiece in the clockwise direction. On the contrary, when the support base 12 of the drive shank 10 is rotated in the counterclockwise direction, the ratchet wheel 40 pushes the pawl member 20 to move toward the left side of the adjusting space 33 of the shell 30. At this time, a clearance defined between the slideway 121 of the drive shank 10 and the sliding face 23 of the pawl member 20 to allow movement of the pawl member 20, so that the toothed engaging face 21 of the pawl member 20 disengages and skips the ratchet teeth 41 of the ratchet wheel 40 to detach the pawl member 20 from the ratchet wheel 40, and the ratchet wheel 40 is not rotated with the pawl member 20. Thus, when the support base 12 of the drive shank 10 is rotated in the counterclockwise direction, the ratchet wheel 40 is detached from the pawl member 20, so that the socket mounted on the drive stud 42 of the ratchet wheel 40 is not driven by the support base 12 of the drive shank 10, and the support base 12 of the drive shank 10 performs an idle rotation. Thus, when each of the two positioning members 14 is positioned in the respective first positioning groove 332 of the shell 30, the support base 12 of the drive shank 10 drives the socket to rotate the workpiece in the clockwise direction and performs an idle rotation in the counterclockwise direction.

As shown in FIG. 6 with reference to FIGS. 1-4, each of the two positioning members 14 is positioned in the respective second positioning groove 333 of the shell 30, and the pawl member 20 rests on the left side of the adjusting space 33 of the shell 30. In such a manner, when the support base 12 of the drive shank 10 is rotated in the counterclockwise direction, the slideway 121 of the drive shank 10 presses the sliding face 23 of the pawl member 20 to push the toothed engaging face 21 of the pawl member 20 toward the ratchet teeth 41 of the ratchet wheel 40, so that the toothed engaging face 21 of the pawl member 20 closely engages the ratchet teeth 41 of the ratchet wheel 40 to combine the pawl member 20 and the ratchet wheel 40 together, and the ratchet wheel 40 is rotated with the pawl member 20. Thus, when the support base 12 of the drive shank 10 is rotated in the counterclockwise direction, the pawl member 20 and the ratchet wheel 40 are combined together, so that the socket mounted on the drive stud 42 of the ratchet wheel 40 is driven by the support base 12 of the drive shank 10 to rotate the workpiece in the counterclockwise direction. On the contrary, when the support base 12 of the drive shank 10 is rotated in the clockwise direction, the ratchet wheel 40 pushes the pawl member 20 to move toward the right side of the adjusting space 33 of the shell 30. At this time, a clearance defined between the slideway 121 of the drive shank 10 and the sliding face 23 of the pawl member 20 to allow movement of the pawl member 20, so that the toothed engaging face 21 of the pawl member 20 disengages and skips the ratchet teeth 41 of the ratchet wheel 40 to detach the pawl member 20 from the ratchet wheel 40, and the ratchet wheel 40 is not rotated with the pawl member 20. Thus, when the support base 12 of the drive shank 10 is rotated in the clockwise direction, the ratchet wheel 40 is detached from the pawl member 20, so that the socket mounted on the drive stud 42 of the ratchet wheel 40 is not driven by the support base 12 of the drive shank 10, and the support base 12 of the drive shank 10 performs an idle rotation. Thus, when each of the two positioning members 14 is positioned in the respective second positioning groove 333 of the shell 30, the support base 12 of the drive shank 10 drives the socket to rotate the workpiece in the counterclockwise direction and performs an idle rotation in the clockwise direction.

Accordingly, the shell 30 is pivoted relative to the support base 12 of the drive shank 10, so that each of the two positioning members 14 is movable into the respective first positioning groove 332 or the respective second positioning groove 333 of the shell 30 so as to change the operation direction of the ratchet wheel 40 easily and conveniently. In addition, the user only needs to hold and pivot the shell 30 relative to the support base 12 of the drive shank 10 so as to change the operation direction of the ratchet wheel 40, so that the user can change the operation direction of the ratchet wheel 40 easily and quickly, thereby facilitating the user operating the reversible ratchet wrench. Further, the user only needs to hold the support base 12 of the drive shank 10 to shake the shell 30 and to drive the shell 30 to pivot relative to the support base 12 of the drive shank 10 by the weight of the shell 30 and the ratchet wheel 40 so as to change the operation direction of the ratchet wheel 40, so that the user can change the operation direction of the ratchet wheel 40 easily and quickly, thereby facilitating the user operating the reversible ratchet wrench.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A reversible ratchet wrench, comprising:

a drive shank having an end portion provided with a support base;

an open shell pivotally mounted on the support base of the drive shank;

a ratchet wheel mounted in the shell and having an outer wall provided with a plurality of ratchet teeth;

a pawl member mounted between the support base of the drive shank and the ratchet wheel and having a first side provided with a sliding face slidably mounted on the support base of the drive shank and a second side provided with a toothed engaging face meshing with the ratchet teeth of the ratchet wheel;

a cover mounted on the shell to cover the ratchet wheel, the pawl member and the support base of the drive shank;

wherein the support base of the drive shank has an end face provided with two opposite arcuate guide rails and an arcuate slideway defined between the two guide rails;

the sliding face of the pawl member is slidably mounted in the slideway of the drive shank and has opposite sides each provided with a guide track slidable on a respective one of the two guide rails of the drive shank.

2. The reversible ratchet wrench in accordance with claim 1, wherein the first positioning grooves and the second positioning grooves of the two opposite sidewalls of the adjusting space of the shell are diagonally opposite to each other.

3. The reversible ratchet wrench in accordance with claim 1, further comprising:

an elastic push member biased between the support base of the drive shank and the sliding face of the pawl member to push the pawl member toward the ratchet wheel.

4. The reversible ratchet wrench in accordance with claim 3, wherein the sliding face of the pawl member has a central portion provided with a mounting hole connected to the slideway of the drive shank;

the elastic push member is mounted in the mounting hole of the pawl member and extended into the slideway of the drive shank.

5. The reversible ratchet wrench in accordance with claim 1, wherein the receiving space of the shell has a substantially circular shape.

6. The reversible ratchet wrench in accordance with claim 1, wherein the pawl member is mounted in the shell and has a substantially semi-circular shape.

7. A reversible ratchet wrench, comprising:

a drive shank having an end portion provided with a support base;

an open shell pivotally mounted on the support base of the drive shank;

a ratchet wheel mounted in the shell and having an outer wall provided with a plurality of ratchet teeth;

a pawl member mounted between the support base of the drive shank and the ratchet wheel and having a first side provided with a sliding face slidably mounted on the support base of the drive shank and a second side provided with a toothed engaging face meshing with the ratchet teeth of the ratchet wheel;

a cover mounted on the shell to cover the ratchet wheel, the pawl member and the support base of the drive shank;

wherein the shell has a first end provided with an adjusting space pivotally mounted on the support base of the drive shank and a second end provided with a receiving space connected to the adjusting space to receive the ratchet wheel;

the support base of the drive shank has an inside provided with a receiving hole;

the adjusting space of the shell has two opposite sidewalls each provided with a first positioning groove and a second positioning groove;

the reversible ratchet wrench further comprises:

two opposite positioning members each movably mounted in the receiving hole of the drive shank and each detachably positioned in any one of the respective first positioning groove and the respective second positioning groove of the shell;

an elastic member mounted in the receiving hole of the drive shank and biased between the two positioning members to push each of the two positioning members toward any one of the respective first positioning groove and the respective second positioning groove of the shell.

8. The reversible ratchet wrench in accordance with claim 7, wherein the first end of the shell has an end face provided with an opening connected to the adjusting space to allow passage of the support base of the drive shank.

9. The reversible ratchet wrench in accordance with claim 7, wherein the ratchet wheel is mounted in the receiving space of the shell to move in concert with the shell relative to the support base of the drive shank.

10. The reversible ratchet wrench in accordance with claim 9, wherein the ratchet wheel is driven by the shell to move relative to the support base of the drive shank when the shell is pivoted relative to the support base of the drive shank;

the pawl member is driven by the ratchet wheel to move relative to the support base of the drive shank.

11. A reversible ratchet wrench, comprising:

a drive shank having an end portion provided with a support base;

an open shell pivotally mounted on the support base of the drive shank;

a ratchet wheel mounted in the shell and having an outer wall provided with a plurality of ratchet teeth;

a pawl member mounted between the support base of the drive shank and the ratchet wheel and having a first side provided with a sliding face slidably mounted on the support base of the drive shank and a second side provided with a toothed engaging face meshing with the ratchet teeth of the ratchet wheel;

a cover mounted on the shell to cover the ratchet wheel, the pawl member and the support base of the drive shank;

wherein the support base of the drive shank is provided with two opposite protruding pivot seats;

the shell has a first side provided with a pivot hole pivotally mounted on one of the two pivot seats of the drive shank;

the cover is provided with a pivot bore pivotally mounted on the other one of the two pivot seats of the drive shank.

12. The reversible ratchet wrench in accordance with claim 11, wherein the first side of the shell is further provided with a limit hole to limit the ratchet wheel;

the cover is further provided with a limit bore to limit the ratchet wheel.

13. The reversible ratchet wrench in accordance with claim 12, wherein the ratchet wheel has a first side provided with a drive stud extending through and protruding outwardly from the limit bore of the cover and a second side provided with a protruding limit flange inserted into the limit hole of the shell.

14. The reversible ratchet wrench in accordance with claim 13, wherein the drive stud of the ratchet wheel has a side provided with a positioning hole to receive a positioning ball which partially protrudes outwardly from the positioning hole of the ratchet wheel;

the ratchet wheel has an inside provided with a stepped receiving chamber connected to the positioning hole;

the reversible ratchet wrench further comprises:

a control rod movably mounted in the receiving chamber of the ratchet wheel and having a first end provided with a control recess that is movable to align with and receive the positioning ball and a second end provided with an enlarged control knob protruding outwardly from the receiving chamber of the ratchet wheel and the limit hole of the shell;

an elastic element mounted on the control rod and biased between the ratchet wheel and the control knob of the control rod to move the control recess of the control rod to push the positioning ball outwardly from the positioning hole of the ratchet wheel.

15. The reversible ratchet wrench in accordance with claim 14, wherein the elastic element is received in the receiving chamber of the ratchet wheel.

16. The reversible ratchet wrench in accordance with claim 11, wherein the shell has an open second side provided with a recessed mounting portion for mounting the cover.

17. The reversible ratchet wrench in accordance with claim 16, wherein the mounting portion of the shell is provided with two screw bores;

the cover is secured in the mounting portion of the shell and is further provided with two fixing holes;

the reversible ratchet wrench further comprises two locking bolts each extending through a respective one of the two fixing holes of the cover and each screwed into a respective one of the two screw bores of the shell to combine the cover with the shell.

18. The reversible ratchet wrench in accordance with claim 16, wherein the cover is fully received and hidden in the mounting portion of the shell.

* * * * *